United States Patent [19]

Franke et al.

[11] 3,980,447

[45] Sept. 14, 1976

[54] PROCESS FOR THE MANUFACTURE OF BROWN COAL BRIQUETTES

[75] Inventors: Friedrich Franke; Werner Wenzel; Mohamed Meraikib; Hans Berkenkamp, all of Aachen, Germany

[73] Assignee: Rheinische Braunkohlenwerke AG, Cologne, Germany

[22] Filed: Nov. 8, 1974

[21] Appl. No.: 522,098

Related U.S. Application Data

[63] Continuation of Ser. No. 354,664, April 26, 1973, abandoned.

[30] Foreign Application Priority Data

Apr. 26, 1972 Germany ..... 2220479

[52] U.S. Cl. ..... 44/10 D; 44/1 G; 44/10 H; 44/10 J; 44/23; 201/6; 201/35

[51] Int. Cl.[2] ..... C10L 5/00; C10B 45/02

[58] Field of Search ..... 201/5, 8, 31, 32, 33, 201/34, 6, 7; 44/16, 10 D, 10 G, 10 H, 10 J, 10 K, 23

[56] References Cited

UNITED STATES PATENTS

| | | | |
|---|---|---|---|
| 1,577,902 | 3/1926 | Fernholtz | 44/1 G |
| 2,825,679 | 3/1958 | Baum | 201/5 X |
| 3,051,628 | 8/1962 | Gorin et al. | 201/5 X |
| 3,190,814 | 6/1965 | Kardaun et al. | 201/34 X |
| 3,316,155 | 4/1967 | Holowaty et al. | 201/34 X |
| 3,444,046 | 5/1969 | Harlow | 201/8 X |
| 3,592,617 | 7/1971 | Alpan et al. | 44/10 H |
| 3,663,186 | 5/1972 | Dzhaparidze et al. | 44/10 H |

*Primary Examiner*—Carl F. Dees
*Attorney, Agent, or Firm*—Edwin E. Greigg

[57] ABSTRACT

A process of manufacturing briquettes from brown coal includes drying brown coal, which is preferably in fine granular form. The dried brown coal is then heated at a first rate up to a temperature in a range of from about 300° to about 320° C. The brown coal is subsequently heated at a second rate, which is less than the first rate, to a temperature in the range of from about 350° to about 400° C. The brown coal is thereafter pressed into briquettes.

20 Claims, 2 Drawing Figures

PROCESS FOR THE MANUFACTURE OF BROWN COAL BRIQUETTES

This is a continuation of application Ser. No. 354,664, filed Apr. 26, 1973, now abandoned.

BACKGROUND OF THE INVENTION

This invention concerns a process for the manufacture of brown coal briquettes in which pre-dried brown coal is heated and pressed in the heated state.

Many processes for the hot-briquetting of coal are known. The majority of these known processes are in the field of the hot-briquetting of bituminous coal. These known processes are especially useful in the hot-briquetting of stone coal, which possesses a natural bakability. Since brown coal does not have a natural bakability characteristic, the experiences gained from processes found suitable for the hot-briquetting of stone coal cannot be transferred directly to brown coal. In the art of the hot-briquetting of brown coal, several techniques have been known. For example, the German Pat. No. 1,024,921 discloses a process in which, for example, finely diminuted hard brown coal is heated, within 3 to 5 minutes, to a temperature in a range of from about 25° to about 50° C below its "dough point", subsequently one separates up to approximately 40% of the coal and heats this portion, in a few seconds, to a temperature which lies in a range approximately from about 30° to about 50° C over the "dough point". The thus treated portion of the coal is re-combined with the untreated portion, and the combined coal is then briquetted. This method is very expensive.

In another process, known from published German Patent application (DAS) No. 1,671,372, the brown coal is heated, prior to briquetting, to a temperature in the range from about 250° to about 300° C, and then briquetted under high pressure. In this process, however, a supplement of up to about 20% baking stone coal is required to be added to the brown coal in order to obtain briquetttes with compressive strength of over 100 kp/cm$^2$ which, however, does not meet all requirements. This process was modified, according to the disclosure of published German Patent Application (DAS) No. 1,671,371 in such a way that after the drying of the coal, in an oxygen-free zone, heating of the brown coal takes place at an extremely high rate. For example, in this modified process, 1 minute is recommended as the time period for the heating of the brown coal to a temperature in a range from about 320° to about 350° C.

The known process, as disclosed in the published German Patent application (DAS) No. 1,671,372, has been further modified according to published German Patent application (DAS) No. 1,912,264 in such a manner that after a very quick drying of the brown coal, a preheating of the coal to a temperature in a range of from about 340° to about 420° C and subsequently a further heating, under pressure in a press, to a temperature of approximately 430° C takes place until the tar vapors have completely escaped from the coal. This known process has the disadvantage that the presses, which are in any case subject to wear, require that special heating devices be incorporated therein. In addition, the pressing time must be increased, in order to be able to conduct properly the postheating pressing.

From processes of the type described in the beginning, it can be considered to be generally known that in a carbonization up to the temperatures of approximately 300° C principally only $CO_2$ and $N_2$ escape (compare "Braunkohle, Warme und Energie", No. 4, 1971, lines 17–19). Only at temperatures above 300° C is the first formation of tar observed.

SUMMARY OF THE INVENTION

It is the principal object of the present invention to provide a process for the manufacturing of briquettes from brown coal which avoids the disadvantages and drawbacks of the above-mentioned known processes.

It is a further object of the present invention to provide a process for the manufacturing of briquettes from brown coal which produces briquettes having desired characteristics of strength.

It is another object of the present invention to provide a process for the manufacturing of briquettes from brown coal which produces briquettes having desired characteristics of strength which they retain in a possible subsequent coking process.

It is an additional object of the present invention to provide a process for the manufacturing of briquettes from brown coal which avoids the addition of additional binding materials, while producing briquettes having required cohesive strengths.

It is yet a further object of the present invention to provide a process for the manufacturing of briquettes from brown coal which avoids the use of complex and expensive techniques.

The foregoing objects, as well as others which are to become apparent from the text below, are accomplished in accordance with the present invention by a process for making briquettes from brown coal in which the brown coal, preferably in fine granular form, is firstly dried. The coal is then heated at a first rate up to a temperature in the range of from about 300° to about 320° C. The brown coal is subsequently heated at a second rate, which is less than the first rate, to a temperature in the range of from about 350° to about 400° C. The brown coal is thereafter pressed into briquettes.

It is suggested, in accordance with the present invention, that after the prior drying of the brown coal, the heating be conducted in a first heating zone or stage up to a temperature in the range of from about 300° to about 320° C and be subsequently conducted in a second heating zone or stage to a temperature in the range of from about 350° to about 400° C. The rate of heating in the second zone or stage is less than that used in the first zone or stage.

By manufacturing briquettes in accordance with the present invention, the formation of tar is controlled in an optimal temperature range in such a way that hydrocarbons and/or carbon-carrying raw materials are formed, which exude in optimal fashion in the interior of the heated coal, which is in the form of a granular mass. The exuded hydrocarbons and/or carbon-carrying raw material constitute the required binding material which is used in the subsequent hot pressing. Furthermore, the emission of volatile components of the brown coal, in particular during liberation of tar in carbonization and in a possible coking step process, is preferably conducted uniformly. The result is that under the simultaneous influence of temperature and the surface forces of the carbonized coal being produced and of the coke, within the granular mass and within the ensuing briquette, a separation and decomposition of the volatile components takes place. This leads to the distillation of tar-like products within the fine structure of the granular mass and of the briquettes, which components supply the required binding forces during the hot-pressing and the subsequent coking. This uniform emission of the volatile components from the pores during the carbonization or the coking of the brown coal is a fundamental requirement for the achievement of a rigid binding of briquettes or coke. Furthermore, the uniform emission of the volatile components suppresses the otherwise possible disintegration of the shrinking briquette in a possible subsequent coking step.

The heating in the first zone or stage can be done relatively slowly in the known fashion. Since the hot-pressing susceptibility of the final product is not damaged by fast heating but is rather enhanced by it, it is advantageous to use a fast heating process, particularly since this would in general be more economical.

According to a further preferred version of the present invention, the heating process in the first zone or stage can be conducted at a rate of from about 30° to over about 60° C per minute. Such a rapid heating of brown coal to a temperature range of from about 300° to about 320° C can be performed, in a manner known per se, in fluidized beds or in fluidized lines or the like. It has been shown to be particularly advantageous, for example, to introduce dry brown coal into a pre-carbonizing fluidized bed, which is operated as an air separator and which delivers carbonizing coal having a grain size of approximately 1 mm, preferably overhead. This delivered fine material can be slowly heated further to a temperature range of from about 350° to about 400° C. The material remaining in the fluidized bed can be directly made into fine coke by further heating.

Since the heating process of the second zone or stage is to be conducted with a lower heating rate than in the first zone or stage, it is advantageous, according to a further preferred feature of the present invention, to use in the second zone or stage a heating rate of from about 1° C per minute to over about 10° C per minute. For brown coal mined in the Rhine region, for example, a heating rate of approximately 2.5° C per minute and a final temperature of approximately 380° C have been shown to be particularly advantageous as well as a heating rate of approximately 10° C per minute and a final temperature of approximately 360° C. Such a slow heating is advantageously conducted in the motionless state, that is, in fixed beds which can be heated through the walls thereof. Another possibility is heating the brown coal in a slowly moving bed, for example, when the coal to be heated is moving in the longitudinal direction through a pipe where the motion can be produced by an interior worm or by the rotation of the suitably inclined pipe or the like. The heating may take place indirectly through the wall of the pipe or directly by means of hot gases which are conducted over or through the charge of brown coal inside the pipe.

The invention advantageously provides the posibility of minimizing the convection of gas around the individual grains of the brown coal in the second heating zone or stage so that the carbonizing gases emanating from the individual grains have sufficient possibility for dissociation or decomposition and so that the precipitating cracking products can contribute to the binding of the individual grains of coal. It can be advantageous to be working under slightly increased pressure.

The heating in the second zone or stage is conducted advantageously in such a way and particularly as long as necessary to ensure that tar hydrocarbons have precipitated at the edge of the pure carbon grains. During the heating of the briquette, the largest part of the bituminous binding material that can be abstracted from these tar hydrocarbons should have emanated from the lattice of solid matter consisting of the carbonizing brown coal together with the tar hydrocarbons. The emanated material occurs principally before the pressing in the form of drops or after the pressing, in the form of threads. Microscopic investigations have shown that within the microscopic lattice of brown coal of the Rhine region which was treated according to the process disclosed in published German Patent application (DAS) No. 1,912,264, no substances usable as binding material had precipitated; whereas, in the same coal treated according to the present invention, droplets of bituminous binding materials had separated or precipitated within the solid material lattice of the coal, this being obviously a precondition for the achievement of a firm briquette in the subsequent hot pressing of coal treated in this way.

It has further been shown to be particularly advantageous if the heating rate of the brown coal in the second zone or stage occurs in an optimized program which is adapted to the particular characteristics of the brown coal being processed. For brown coal of the Rhine region it has been proved to be advantageous to conduct the temperature increase of the coal per unit of time up to the range of from about 360° to about 380° C in such a manner that a uniform delivery of the volume of carbonizing gas occurs during the entire heating period and where the heating rate lies in the range of from about 1° per minute to about 10° C per minute. The liberated gas volume should lie near from about 0.4 to about 0.7 liters per minute per kilogram of the dry brown coal forming the charge. A heating rate much higher than 10° C per minute has been shown to be too high. It can be advantageous to effect an partial hydrogenation at a temperature of 400° C and below, using hydrogen gas. The brown coal heated according to the invention is subsequently pressed in known fashion where, in particular, conventional stamping presses and conventional rolling presses can be utilized. A heating according to the invention can further produce, because of the tar-like distillation products surrounding the grains of carbon, a self-lubrication between the coal and the press during the pressing step which leads to an almost black, glossy outer surface of the briquettes so produced. It is possible also to add binding materials to the granular mass prior to pressing.

According to a further preferred feature of the present invention, the briquettes produced by hot-briquetting can, for the production of highly refractory lump coke, be heated preferably in a chute or, for example, on a traveling grate, to temperatures up to from about 950° to about 1100° C where the temperature control is such that approximately constant volume of gas are emitted from the briquettes per unit of time. In this process, that is in connection with the production of very refractory lump coke, another substantial advantage of the present invention becomes apparent. This advantage is that the binding forces which act during the hot pressing, that is, in the briquetting, are substantially retained during a subsequent coking and therefore help to determine the strength of the end product, that is, of the coke. Furthermore, a hot-briquetting before a subsequent coking brings the advantages that the water as well as a larger part of the other volatile compounds have left the briquette prior to the final pressing. These volatile compounds, therefore, advantageously do not have to emerge through the briquette during the coking step. In addition, the shrinking, which usually occurs during coking, thereby endangering the strength of the briquette, has, as far as possible, been made to occur prior to the pressing operation.

The pressure of the emanating carbonizing and coking gases can be regulated, in accordance with a preferred feature of the invention, in a range of up to about 5 atmospheres. It is possible also to adjust the pressure of the emanating carbonizing and coking gases in a range of up to approximately 1 Torr.

According to a further preferred characteristic of the invention, the briquettes or the coked briquettes, as the case may be, can be subjected to a partial gasification.

DESCRIPTION OF THE PREFERRED EMBODIMENTS

Figure 1:
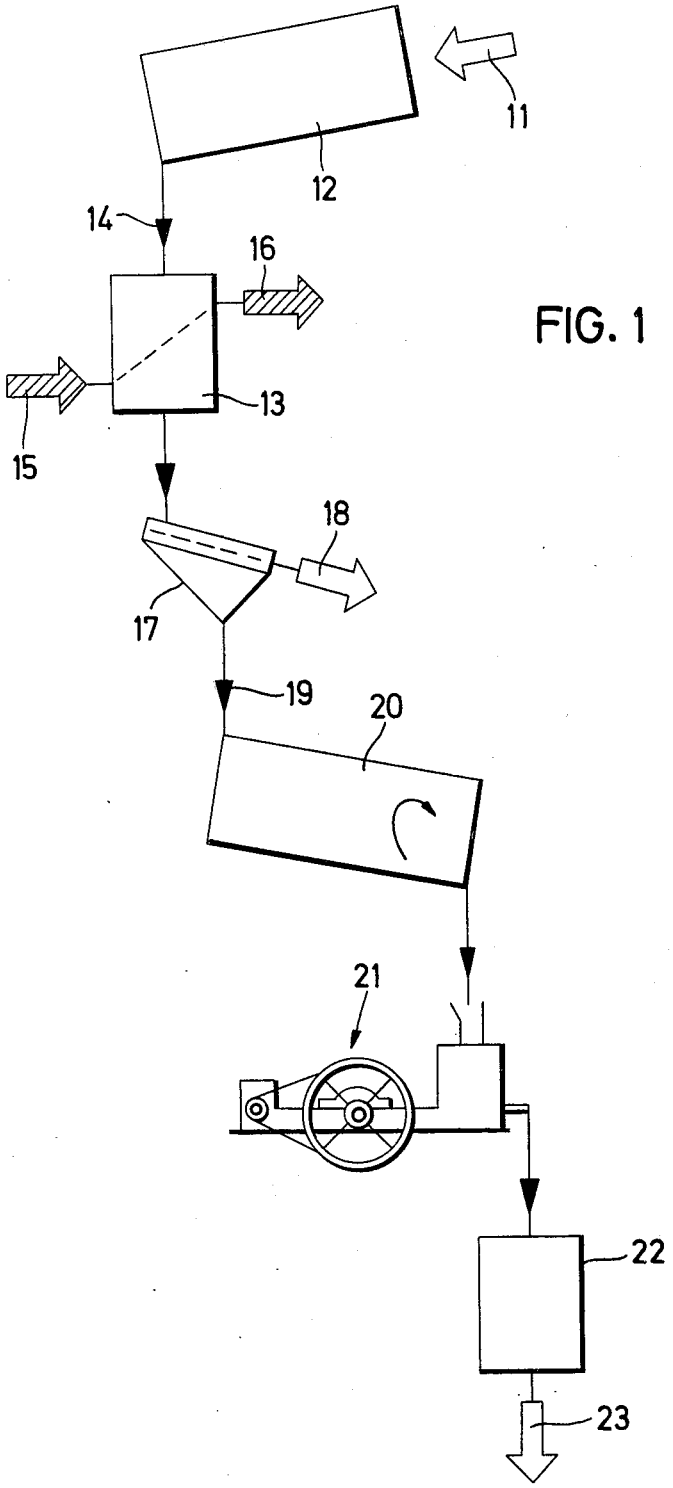
FIG. 1 is a schematic diagram of an exemplary apparatus suitable for carrying out the process of making briquettes according to the present invention.

In the exemplary embodiment according to FIG. 1, raw brown coal is introduced at 11 into a tubular drier 12 which, in conventional fashion, is rotatable about its longitudinal axis. Downstream from the tubular drier 12 there is located a fluidized bed 13, where the dry brown coal moving in the direction indicated by arrow 14, arrives from the tubular drier 12. The fluidized bed 13 is heated by flue gas, whose in- and outlets are designated, respectively, by arrows 15 and 16. To the fluidized bed 13 is connected a classification device 17, in which the coarse grain is separated from the brown coal. This coarse grain, whose separation is symbolized by arrow 19 is led to a further use, for example, a hydration or post-coking process. The remaining fine grained brown coal, designated generally by the arrow 19, is fed into a reactor 20 and is heated therein to the desired final temperature, uniform degasification resulting. The thus heated fine grained brown coal is subsequently hot-briquetted in a press 21, preferably without the addition of any binding material. A post-coking process or step, which preferably results in a uniform degasification, can follow the hot-briquetting step. For example, the briquettes can be fed to a chute or a traveling grate 22, where they can be further heated, so that the final result will be the production of lump coke, designated generally by arrow 23, from the briquettes subjected to the coking process.

Figure 2:
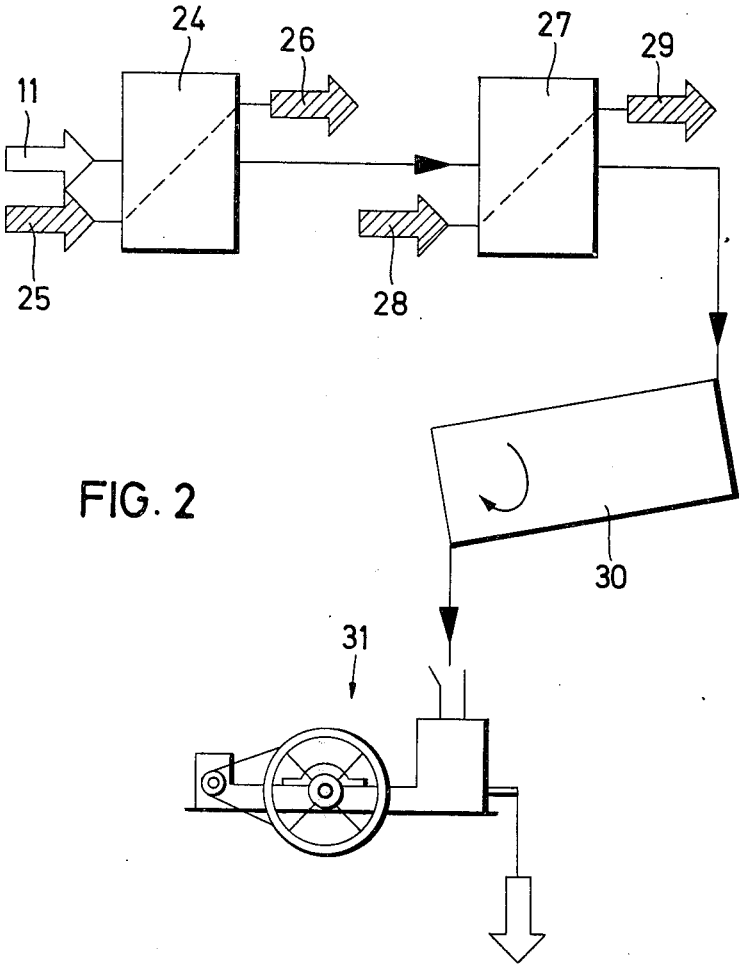
FIG. 2 is a schematic diagram of a second exemplary apparatus suitable for carrying out the present invention.

In the exemplary apparatus embodiment shown in FIG. 2, raw brown coal designated generally by arrow 11, is led into a fluidized bed 24 for drying. This occurs by means of flue gases whose inlet and outlet are designated respectively by arrows 25 and 26.

The brown coal superficially dried in the fluidized bed 24 is conducted to a subsequent second fluidized bed 27, in which heating occurs with resulting carbonization, the necessary heat being provided by hot flue gas. The inlet and outlet for the flue gases are designated respectively by arrows 28 and 29. From the fluidized bed 27 the pre-carbonized brown coal leaves with a temperature in a range from about 300° to about 350° C. The rapid heating in the flue stream installations has the effect of a substantial diminution of the pre-carbonized brown coal to a grain size of 1 mm or less. After a heating to, for example, 380° C, with uniform degasification, for example, in an externally heated reactor 30, the pre-carbonized brown coal is led to the subsequent press 31 and is hot-briquetted therein, preferably without using added binding materials.

The further degasification of the hot briquettes up to the final coking temperature can also advantageously occur at a controlled heating rate, where the control of the heating rate can be such as to lead to the development of volumes of carbonizing or coking gas per unit of time, which volumes of gas are as uniform as possible.

The post-coking installation 22, shown in the exemplary embodiment of FIG. 1, can be operated with positive as well as negative gauge pressure. Particularly advantageous is a coking, under negative gauge pressure, so that the volatile components emanating during the coking process can readily pass through small pores and restricted passages. The finer pore structure resulting therefrom leads to a formed coke having proportion of micro-pores. Such a coke lends itself particularly well for adsorption purposes. For example, a post-coking without post-gasification of hot briquettes produced according to the invention, and made with a final coking temperature of 950° C, produced a coke exhibiting a surface area of approximately 132 $m^2/g$ and a pore volume of approximately 0.12 $cm^3/g$, where a volume of 0.11 $cm^3/g$ had a pore radius $\leq$ 50 Angstroms. The sharply limited radii permit, for example, a use of the coked material as a molecular sieve. Activation and adjustment of the pore radii, after coking, can be effected by means of known partial gasification techniques using hydrogen or water vapor or carbon dioxide, or mixtures of them.

EXAMPLE 1

A dry brown coal from the Rhine region, which contained 15% water and had a graininess up to 6 mm, was heated, according to the teaching in published German Patent application (DAS) No. 1,912,264, in a fluidized bed oven to approximately 350° C. Hot-briquetting under pressures of up to 2000 $kp/cm^2$, without additional material, did not yield a usable briquette; rather, the briquette disintegrated.

EXAMPLE 2

In a further test, dry brown coal from the Rhine region was heated at a heating rate of 40° C/min to 310° C. Subsequently, this coal was heated to 380° C in a stationary bed heated, through its walls, to 380° C at a heating rate between 1.8° and 3.4° C/min. The carbonizing gas volume uniformly exuded during this entire heating period was in the neighborhood of 0.53 l/min per kilogram of charged dry brown coal. After achieving the heating temperature of 380° C, the coal was pressed in a stamping press without further heating. The hot briquettes produced in this manner exhibited compressive strength of 2000 $kp/cm^2$ after application of a stamping pressure of 322 $kp/cm^2$. The briquettes so produced were subjected to a post-coking treatment at a temperature of 950° C. This post-coking treatment resulted in compressive strengths of the coked briquettes of 270 $kp/cm^2$.

EXAMPLE 3

Under otherwise identical conditions as set forth in Example 2, but using a stamping press pressure of only 1200 kp/cm², the thus produced briquettes showed compressive strengths of approximately 330 kp/cm².

That which is claimed is:

1. A process for manufacturing briquettes from brown coal comprising, in combination:
   a. drying brown coal;
   b. heating said brown coal substantially free of added material up to a temperature in a range from about 300° to about 320°C at a selected first rate;
   c. subsequently heating said brown coal substantially free of added material up to a temperature in a range of from about 350° to about 400°C at a selected second rate which is less than said first rate to form bituminous binding material on grains of said brown coal so as to derive the binding material required for the briquettes; and
   d. thereafter pressing said brown coal substantially free of added material into briquettes without separating the binding material produced in step (c); whereby firm briquettes are produced in which the binding material substantially consists of material derived from the coal itself.

2. A process as defined in claim 1, wherein said selected first rate is in a range from about 30° per minute to about 60°C per minute.

3. A process as defined in claim 1, wherein said selected second rate is in a range from about 1° per minute to about 10°C per minute.

4. A process as defined in claim 1, including feeding fine particles of said brown coal into a fluidized bed where the step of heating at said selected first rate is accomplished, and thereafter conducting said fine particles to a secondary heating stage.

5. A process as defined in claim 1, wherein said fine particles are delivered overheadedly to said fluidized bed.

6. A process as defined in claim 1, wherein said heating at said selected second rate is conducted with a substantially uniform degasification rate of said brown coal.

7. A process as defined in claim 1, wherein said substantially uniform degasification rate liberates gas from said brown coal at a rate in a range of from about 0.4 liters to about 0.7 liters per minute per kilogram of charged dry brown coal.

8. A process as defined in claim 1, wherein heating of said brown coal continues for a sufficient period so that bituminous binding material separates principally in thread form.

9. A process as defined in claim 1, wherein said brown coal is conducted through a zone maintained at a temperature of up to about 400°C for partial hydrogenation of said brown coal in the presence of hydrogen.

10. A process as defined in claim 1, wherein distillation products from said brown coal surround precarbonized carbon bodies and provide self-lubrication between said brown coal and a press in which said pressing step is accomplished, resulting in the briquettes having a glossy outer surface.

11. A process as defined in claim 1, including adding additional binding material to said brown coal, which is in granular form, prior to the pressing step.

12. A process as defined in claim 1, wherein the pressing step is accomplished at a temperture which is lower than the temperature to which said brown coal is heated at said selected second rate.

13. A process as defined in claim 1, including passing the briquettes through a chute and heating said briquettes during passage to a temperature in a range from about 950° to about 1100°C for liberating gas therefrom.

14. A process as defined in claim 1, including passing the briquettes over a grate and heating said briquettes during passage to a temperature in a range from about 950° to about 1100°C for liberating gas therefrom.

15. A process as defined in claim 13, including controlling the temperature within said range of from about 950° to about 1100°C so that substantially constant volumes of gas are liberated per unit of time.

16. A process as defined in claim 14, including controlling the temperature within said range of from about 950° to about 1100°C so that substantially constant volumes of gas are liberated per unit of time.

17. A process as defined in claim 1, including controlling pressure of emanating carbonizing and coking gases from said brown coal within a range of up to about 5 atmospheres.

18. A process as defined in claim 1, including controlling pressure of emanating carbonizing and coking gases from said brown coal within a range of up to about 1 Torr.

19. A process as defined in claim 1, including subjecting the briquettes to partial gasification.

20. A process as defined in claim 1, wherein the step of subsequently heating said brown coal substantially free of added material up to a temperature in a range of from about 350° to about 400°C at a selected second rate which is less than said first rate to activate bituminous binding material on and in grains of said brown coal so as to derive the binding material required for the briquettes is effected by using flue gas.

* * * * *